United States Patent [19]

Mohr

[11] Patent Number: 5,052,133

[45] Date of Patent: Oct. 1, 1991

[54] MOBILE BALLAST REGULATING MACHINE

[75] Inventor: Pierre Mohr, Ligny en Barrois, France

[73] Assignee: Franz Plasser Bahnbaumaschinen-Industriegesellschaft m.b.H., Vienna, Austria

[21] Appl. No.: 592,218

[22] Filed: Oct. 3, 1990

[30] Foreign Application Priority Data

Nov. 23, 1989 [EP] European Pat. Off. ..... 89121643.4

[51] Int. Cl.[5] ..... E02F 5/22; E01B 27/02

[52] U.S. Cl. ..... 37/104; 37/214; 104/279

[58] Field of Search ..... 37/104, 105, 106, 107, 37/198, 214, 215; 104/279

[56] References Cited

U.S. PATENT DOCUMENTS

| | | | |
|---|---|---|---|
| 354,675 | 12/1886 | Bennett | 37/214 |
| 690,788 | 1/1902 | Spurlin | 37/104 |
| 3,305,952 | 2/1967 | Dressler | 37/104 |
| 3,491,467 | 1/1970 | Finger | 37/104 |
| 4,235,029 | 11/1980 | Ulm | 37/104 |
| 4,835,887 | 6/1989 | Theurer | 37/104 |

FOREIGN PATENT DOCUMENTS 389132 9/1987 Austria .

*Primary Examiner*—David H. Corbin
*Assistant Examiner*—Arlen L. Olsen
*Attorney, Agent, or Firm*—Collard, Roe & Galgano

[57] ABSTRACT

A mobile ballast regulating machine comprises a machine frame supported by undercarriages on the track for mobility therealong in an operating direction, a vertically adjustable ballast plow arrangement comprising a substantially vertical ballast damming wall extending transversely to the longitudinal extension of the machine frame to the opposite machine frame sides, a respective ballast guide plate associated with the damming wall at each machine frame side, each guide plate being adjustable to define a desired angle with the respective machine frame side, and a cover plate preceding the damming wall in the operating direction and connected to the damming wall, the cover plate extending substantially parallel to a plane defined by the track and immediately above the running surfaces of the rails, and the cover plate including opposite ends associated with the rails and extending in the direction of the longitudinal machine frame extension, each cover plate end projecting obliquely downwardly towards the base of the rail associated therewith along the field side thereof, and drives vertically adjustably connecting the ballast plow arrangement to the machine frame.

14 Claims, 2 Drawing Sheets

Fig. 4
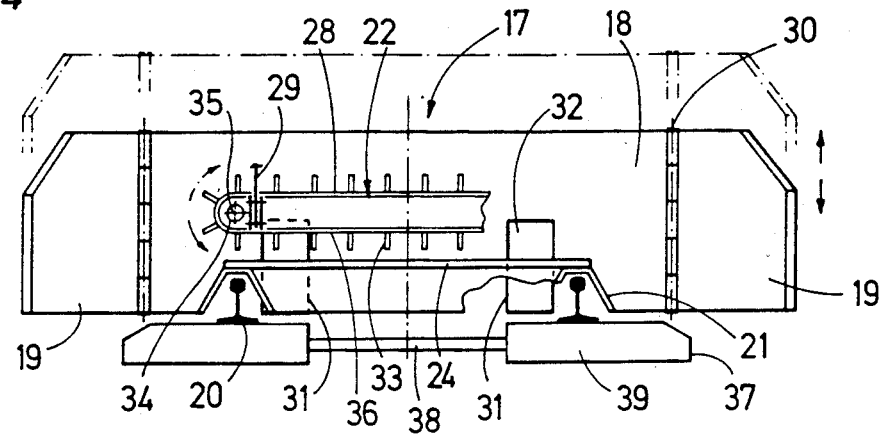
Fig. 5
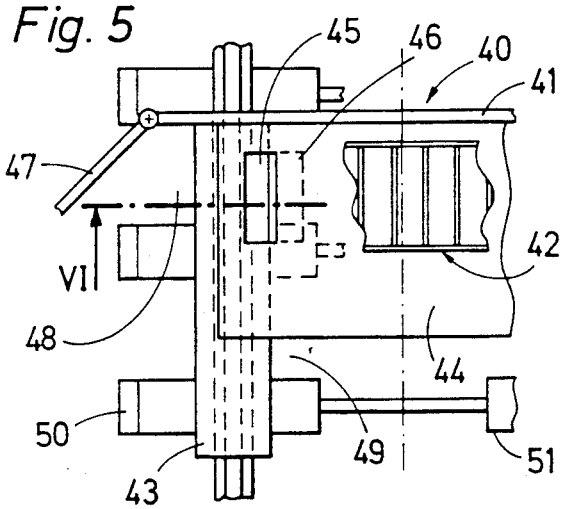
Fig. 6
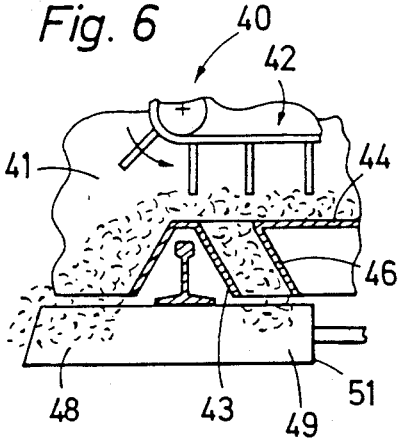
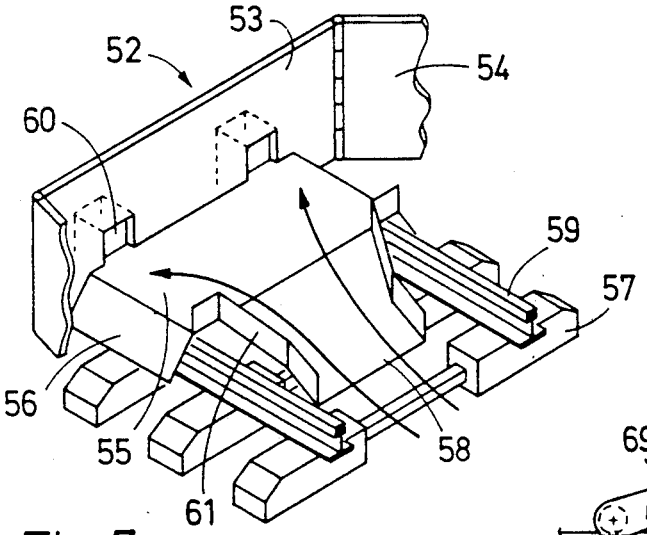
Fig. 7
Fig. 8
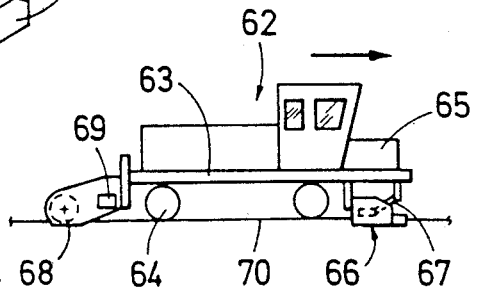

MOBILE BALLAST REGULATING MACHINE

BACKGROUND OF THE INVENTION

1. Field of the Invention

The present invention relates to a mobile machine for distributing and shaping the ballast bed of a railroad track consisting of two rails fastened to ties, each rail having a gage side, a field side, a running surface and a base supported on the ballast bed, which comprises a machine frame supported by undercarriages on the track for mobility therealong in an operating direction, the machine frame having a longitudinal extension and opposite sides extending in the direction of the longitudinal extension, a vertically adjustable ballast plow arrangement comprising a substantially vertical ballast damming wall extending transversely to the longitudinal extension of the machine frame to the opposite machine frame sides, and a respective ballast guide plate associated with the damming wall at each machine frame side, each guide plate being adjustable to define a desired angle with the respective machine frame side. Drive means vertically adjustably connect the ballast plow arrangement to the machine frame.

2. Description of the Prior Art

U. S. Pat. No. 4,835,887, dated June 6, 1989, discloses a ballast regulator of this general type. The ballast plow arrangement is vertically adjustably mounted on the machine frame between two undercarriages supporting the machine frame on the track, and the plow arrangement comprises a transversely extending ballast damming wall and rail-bridging tunnel-shaped elements affixed thereto and preceding the wall to cover the two track rails. Center and side plowshares are arranged respectively between the tunnel-shaped elements and at the opposite ends of the ballast damming wall. The plow arrangement also comprises a transverse ballast conveying band immediately behind the damming wall, followed by a ballast scraping sheet metal member and a ballast broom. The vertically adjustable ballast plow arrangement is preceded in the operating direction by transversely and vertically adjustable shoulder plowshares connected to the machine frame. This ballast plow arrangement enables any plowed excess ballast to be selectively directed to any portion of the ballast bed by suitably adjusting the positions of the center, side and shoulder plowshares, any excess ballast flowing over the upper edge of the ballast damming wall being directed to a selected shoulder by the transverse ballast conveying band.

Austrian patent No. 389,132, of Mar. 15, 1989, discloses a continuous action track leveling, lining and tamping machine incorporating track stabilizing and ballast plowing arrangements. The ballast plow arrangements are vertically adjustably mounted in front of the ballast tamping and track stablizing units, respectively, and serve to provide sufficient ballast for the succeeding tamping and track stabilizing operation, respectively.

SUMMARY OF THE INVENTION

It is the primary object of this invention to improve a ballast regulator of the first-described type so that the ties, particularly ties consisting of two interconnected concrete blocks, may be embedded in the ballast at different depths.

This and other objects are accomplished according to the invention with a ballast plow arrangement which additionally comprises a cover plate preceding the damming wall in the operating direction and connected to the damming wall, the cover plate extending substantially parallel to a plane defined by the track and immediately above the running surfaces of the rails, and the cover plate including opposite ends associated with the rails and extending in the direction of the longitudinal machine frame extension, each cover plate end projecting obliquely downwardly towards the base of the rail associated therewith along the field side thereof.

Such a ballast plow arrangement enables the two blocks of the ties supporting the two track rails to be embedded deeply in the ballast dammed up by the transverse ballast damming wall while the level of the ballast bed in the center between the tie blocks is lower, as required. This eliminates the previously required, cumbersome and expensive removal of excess ballast in the center of the track. The general ballast bed level may be readily regulated by vertically adjusting the ballast plow arrangement. In this manner, the plow arrangement of the present invention may be used in front of a ballast tamping machine to provide sufficient ballast in the area of the track rails for effectively tamping the ties even if considerable track level corrections were required.

According to one preferred feature of this invention, the damming wall defines openings immediately adjacent the gage sides of the rails, the cover plate forming lower edges of the openings. These openings in the damming wall will direct dammed ballast also to the gage sides of the rails while the track center remains covered by the cover plate to prevent plowed ballast from being directed thereto.

Preferably, the machine further comprises ballast distributing chutes surrounding the openings and affixed to a rear side of the damming wall, the chutes having lower outlets opposite the openings and extending substantially parallel to the track plane. The back pressure on the plowed ballast on the cover plate will force this ballast through the openings and down the chutes to be deposited next to the gage sides of the rails.

According to another embodiment, the cover plate defines openings immediately adjacent the gage sides of the rails, and the machine further comprises ballast distributing chutes surrounding the openings and affixed to an underside of the cover plate. This will cause the plowed ballast on the cover plate to flow under gravity through the openings and the ballast distributing chutes to the gage sides of the rails.

The machine may further comprise two tunnel-shaped elements associated with the two track rails and extending in the direction of the longitudinal extension of the machine frame, the tunnel-shaped elements bridging the rails and being connected to an underside of the cover plate. This makes it possible to equip existing ballast plow arrangements with the cover plate of the invention, the obliquely projecting cover plate ends at the field sides of the track rails being formed by the outer walls of the tunnel-shaped rail-bridging elements.

In accordance with another preferred feature of the present invention, the cover plate further includes a forward end opposite the damming wall and projecting obliquely downwardly towards the ties, the forward cover plate end having a transverse edge extending below the base of the rails. With such a cover plate, any excess ballast in the center of the track is readily removed as the forward cover plate end bites into the ballast during the continuous advance of the machine and the desired lower ballast bed level in the center between the two concrete tie blocks supporting the rails is thus produced.

Preferably, the machine further comprises a power-driven ballast conveying device extending transversely to the longitudinal extension of the machine frame, the ballast conveying device being arranged above the cover plate and immediately preceding the damming wall in the operating direction. If excess plowed ballast can be taken up only at one shoulder, such a ballast conveying device can transport any such excess ballast to the opposite shoulder. In a superelevated track section, the ballast conveying device can prevent an undesired ballast flow in the direction of the lower track rail. Such a ballast conveying device may comprise a conveyor chain equipped with ballast conveying entrainment elements projecting from the conveyor chain, and two guide pulleys over which the conveyor chain is trained, the guide pulleys being arranged adjacent the opposite machine frame sides and having rotary axes extending parallel to the longitudinal machine frame extension. The conveyor chain may have a lower course adjacent the cover plate and extending substantially parallel thereto, and a reversible power drive may be provided for rotating the guide pulleys in selected opposite directions. A conveyor chain is a simple device for selectively distributing the plowed ballast, enabling an even ballast distribution to all track support points even if the plowing produces excess ballast only at one shoulder. If drive means is provided for independently connecting the ballast conveying device to the machine frame for vertically adjusting the device with respect to the machine frame, the transverse conveyance of the plowed ballast may be rapidly adjusted to the amount of ballast accumulating at the shoulders.

According to yet another preferred feature, each ballast guide plate is connected to the damming wall at a respective end thereof and is pivotal thereat about a vertical axis for adjustment of the desired angle. This further facilitates the displacement of plowed ballast from the shoulders, suitable pivoting of the ballast guide plates automatically causing the ballast to be moved transversely onto the cover plate. Preferably, the machine further comprises a respective vertically and transversely adjustable shoulder ballast plow preceding each ballast guide plate in the operating direction. This enables ballast to be guided from the lateral edges of the ballast bed towards the guide plates, which operate at a higher level than the shoulder ballast plow and displace the ballast towards the cover plate.

In a further preferred embodiment of this invention, the machine further comprises two vertically adjustable flanged rollers connected to a rear side of the damming wall and arranged for engagement with the track rails, and drive means for vertically adjusting the flanged rollers. This arrangement enables the plow arrangement with the damming wall to be vertically adjusted for selectively changing the amount of ballast to be deposited in the cribs.

Finally, the mobile machine may further comprise an operating carrier frame longitudinally displaceably mounted on the machine frame and trailing the ballast plow arrangement in the operating direction, the operating carrier frame supporting a ballast tamping unit and a track leveling and lining unit preceding the ballast tamping unit in the operating direction whereby the machine constitutes a continuous action track leveling, lining and tamping machine. This will require an elongated machine frame which, for proper operation in track curves, will preferably be a two-part frame whose parts are pivotally linked to each other. Such a continuous action track leveling, lining and tamping machine will operate at high efficiency, enabling the desired ballast regulation and the track position correction to proceed in a single operating stage.

BRIEF DESCRIPTION OF THE DRAWING

The above and other objects, advantages and features of the invention will become more apparent from the following detailed description of certain now preferred embodiments thereof, taken in conjunction with the accompanying, partly schematic drawing wherein

FIG. 4 is a frontal end view of the ballast plow arrangement, seen in the direction of arrow IV in FIG. 3;

FIG. 5 is a fragmentary top view showing another embodiment of a ballast plow arrangement according to this invention;

FIG. 6 is a fragmentary cross section of this embodiment, along the line indicated by arrow VI in FIG. 5;

FIG. 7 is a fragmentary perspective view showing a preferred embodiment of the cover plate of the ballast plow arrangement; and FIG. 8 is a diagrammatic side elevation of another type of mobile track surfacing machine incorporating a ballast plow arrangement according to the invention.

DETAILED DESCRIPTION OF PREFERRED EMBODIMENTS

Figure 1:
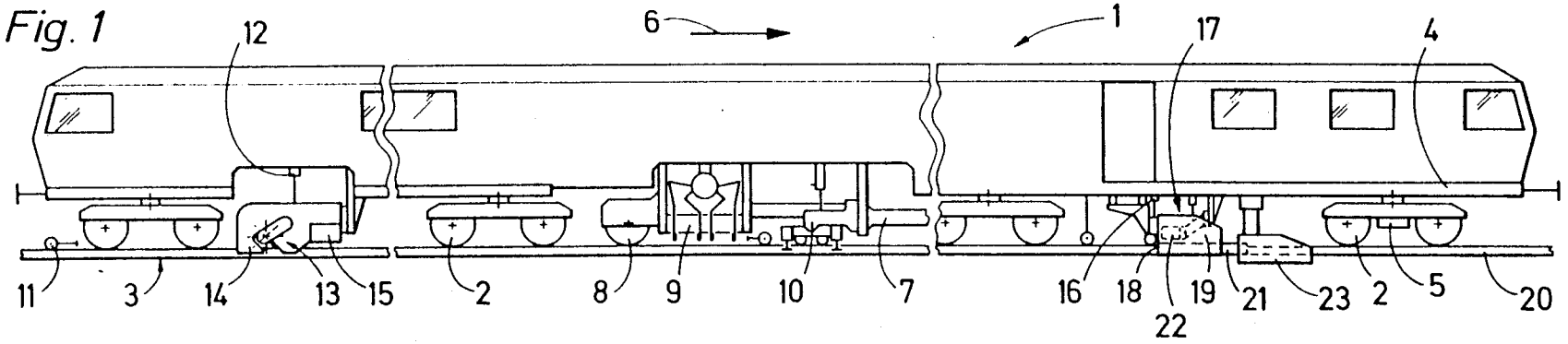
FIG. 1 is a die elevational, diagrammatic view of a continuous action track leveling, lining and tamping machine incorporating the ballast plow arrangement of the present invention.

The mobile machine illustrated in FIG. 1 is a continuous action track leveling, lining and tamping machine 1 which comprises two-part machine frame 4 and means for distributing and shaping the ballast bed of railroad track 3 consisting of two rails 20 fastened to ties 37, each rail having a gage side, a field side, a running surface and a base supported on the ballast bed. The machine frame is supported by several undercarriages constituted by swivel trucks 2 on track 3 for mobility therealong in an operating direction indicated by arrow 6, drive 5 enabling machine 1 to be advanced continuously in the operating direction during the operation of the machine. Machine frame 4 has a longitudinal extension and opposite sides extending in the direction of the longitudinal extension, and operating carrier frame 7 is longitudinally displaceably mounted on the machine frame and trails ballast plow arrangement 17 in the operating direction, the operating carrier frame supporting vertically adjustable twin ballast tamping unit 9 and vertically and transversely adjustable track leveling and lining unit 10 preceding the ballast tamping unit in the operating direction. A rear end of operating carrier frame 7 is supported on track 3 by undercarriage 8 while its front end is longitudinally displaceably carried by machine frame 4. A longitudinal displacement drive links the operating carrier frame to the machine frame for cyclically displacing the operating carrier frame while the machine frame continuously advances along the track. A track leveling and lining reference system controlling the leveling and lining operation comprises measuring axles 11. Vertically adjustable ballast broom 13 is mounted on machine frame 4 immediately preceding rear undercarriage 2, this ballast broom being linked to the machine frame by vertical adjustment drive 12 and comprising power-driven rotatable ballast broom 14 designed to sweep ballast from the ties to a transverse conveyor 15 immediately preceding the broom.

Figure 3:
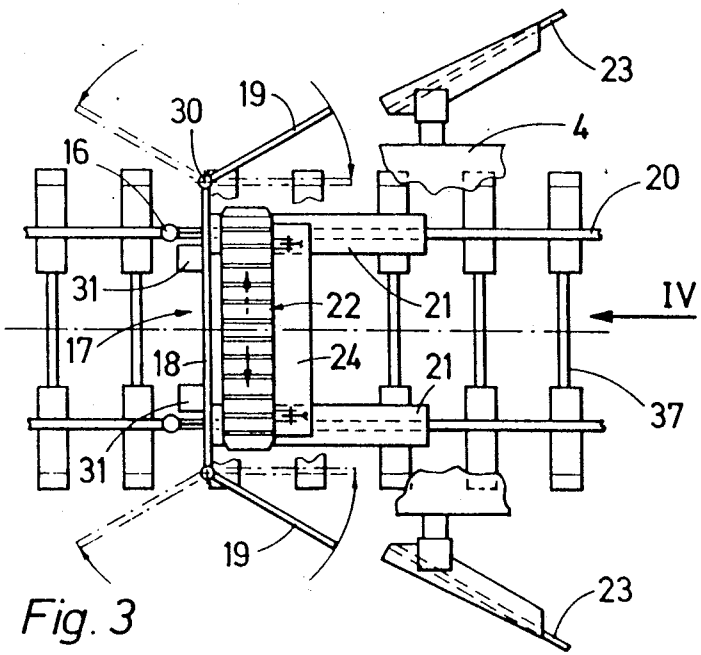
FIG. 3 is a top view of the ballast plow arrangement of FIG. 2, at a smaller scale.
Figure 2:
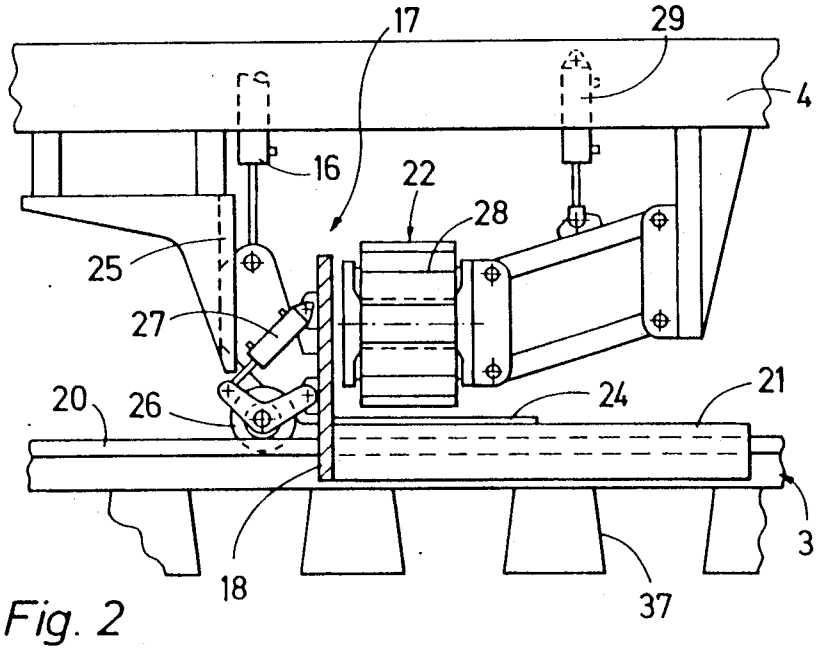
FIG. 2 is an enlarged, fragmentary side elevation showing an embodiment of the ballast plow arrangement.

Referring to the embodiment of FIGS. 2-4, mobile machine 1 comprises vertically adjustable ballast plow arrangement 17 mounted immediately behind front swivel truck 2 and comprising substantially vertical ballast damming wall 18 extending transversely to the longitudinal extension of machine frame 4 to the opposite machine frame sides, respective ballast guide plate 19 associated with damming wall 18 at each machine frame side, each guide plate being adjustable to define a desired angle with the respective machine frame side (see chain-dotted lines in FIG. 3), and cover plate 24 preceding damming wall 18 in the operating direction and connected to the damming wall. The cover plate extends substantially parallel to a plane defined by track 3 and immediately above the running surfaces of the rails, and the cover plate includes opposite ends (see 56 in FIG. 7) associated with the rails and extending in the direction of the longitudinal machine frame extension, each cover plate end projecting obliquely downwardly towards of the base of the rail associated therewith along the field side thereof. Drive means 16 vertically adjustably connects ballast plow arrangement 17 to machine frame 4.

Ballast plow arrangement 17 is shown further to comprise power-driven ballast conveying device 22 extending transversely to the longitudinal extension of machine frame 4, the ballast conveying device being arranged above cover plate 24 and immediately preceding damming wall 18 in the operating direction. The illustrated ballast conveying device comprises conveyor chain 28 equipped with ballast conveying entrainment elements 33 projecting from the conveyor chain, and two guide pulleys 34 over which the conveyor chain is trained, the guide pulleys being arranged adjacent the opposite machine frame sides and having rotary axes extending parallel to the longitudinal machine frame extension. Conveyor chain 28 has a lower course 36 adjacent cover plate 24 and extending substantially parallel thereto, and reversible power drive 35 rotates the guide pulleys in selected opposite directions.

Drive means 29 independently connects ballast conveying device 22 to machine frame 4 for vertically adjusting the device with respect to the machine frame. Ballast conveying device 22 comprises a carrier frame and a parallelogram linkage supports this carrier frame on the machine frame, drive means 29 linking the parallelogram linkage to the machine frame for vertical adjustment of ballast conveying device 22.

Each ballast guide plate 19 is hinged to damming wall 18 at a respective end thereof and is pivotal thereat about a vertical axis 30 for adjustment of the desired angle. Respective vertically and transversely adjustable shoulder ballast plow 23 precedes each ballast guide plate 19 in the operating direction (the ballast guide plates and shoulder ballast plows not being shown in FIG. 2 to show the other structural components more clearly).

The mobile machine further comprises two vertically adjustable flanged rollers 26 connected to a rear side of damming wall 18 and arranged for engagement with the track rails, and drive means 27 are capable of vertically adjusting the flanged rollers independently of the damming wall adjustment.

Damming wall 18 of ballast plow arrangement 17 defines openings 32 immediately adjacent the gage sides of the rails, cover plate 24 forming lower edges of the openings and ballast distributing chutes 31 surrounding the openings. The chutes are affixed to a rear side damming wall 18 and have lower outlets opposite the openings and extending substantially parallel to the track plane. Any ballast accumulating on cover plate 24 is forced through openings 32 as machine 1 advances and flows through the chutes to the gage sides of the rails. Substantially the same effect is achieved in the embodiment of FIG. 6, wherein cover plate 44 defines openings immediately adjacent the gage sides of the rails, and ballast distributing chutes 46 surrounding the openings and affixed to an underside of the cover plate distribute the ballast to the gage sides of the rails.

Illustrated ties 37 are so-called block ties consisting of two concrete blocks 39 respectively supporting the two track rails 20, which are fastened thereto, and interconnected by steel carriers 38 extending over the center of the track. Proper ballasting of such ties requires the ballast bed level between the two concrete blocks to be about 7 cm below the level of the rail bases. The lower outlet of the two chutes 31 at the gage sides of the rails covers the ballast bed region delimited by rails 20 and the gage ends of concrete tie blocks 39.

In operation, ballast plow arrangement 17 is lowered onto track 3 by actuating hydraulic drives 16 until flanged wheels 26 engage rails 20. At the same time, shoulder plows 23 are lowered into their operating position. As machine 1 continuously advances along the track in the operating direction indicated by arrow 6 while tamping unit 9 cyclically tamps ties 37, the ballast plow arrangement will provide sufficient plowed ballast to the ballast bed regions at tie blocks 39 to enable proper tamping of the ballast under the tie blocks to proceed even in track sections which require substantial track level correction. The vertical and angular positions of shoulder plows 23 and ballast guide plates 19 will be so adjusted that excess shoulder ballast is displaced towards ballast damming wall 18. The plowed ballast accumulating on cover plate 18 will then automatically flow over the downwardly projecting opposite cover plate ends extending over the field sides of rails 20 into the cribs adjacent the field side ends of tie blocks 39, any remaining ballast on the cover plate being forced through openings 32 and down chutes 31 into the cribs adjacent the gage sides of the rails. If there is too little or no excess ballast plowed at one shoulder, ballast conveying device 22 may be lowered by actuation of hydraulic drives 29 and rotating drive 35 operated to transport excess plowed ballast from the opposite shoulder to the one shoulder. The cover plate prevents any excess ballast from being deposited in the center of the track. The desired ballast bed level may be selectively adjusted by operating hydraulic drives 27 to vary the spacing between the upper side of the ties and the lower end of damming wall 18 and the lower outlets of chutes 31.

In the embodiment of FIGS. 5 and 6, ballast plow arrangement 40 is shown to comprise damming wall 41, ballast conveying device 42 and tunnel-shaped, rail-bridging elements 43 interconnected by superposed cover plate 44. Adjacent the gage sides of the track rails, the cover plate defines openings 45 leading into ballast distributing chutes 46 affixed to the underside of the cover plate. In this way, the plowed ballast directed by guide plates 47 onto cover plate 44 and towards damming wall 41 falls into the cribs at field side 48 and gage side 49 adjacent block ties 51.

In the embodiment illustrated in FIG. 7, ballast plow arrangement 52 comprises damming wall 53 defining openings 60 immediately adjacent the gage sides of rails 59. The chutes are affixed to a rear side of damming wall 53 and have lower outlets opposite the openings and extending substantially parallel to the track plane. As indicated by the arrows, any ballast accumulating on cover plate 55 of the ballast plow arrangement is forced through openings 60 as machine 1 advances and flows through the chutes to the gage sides of rails 59

While in the embodiments shown in FIGS. 2 to 6, two tunnel-shaped elements 21 are associated with the two track rails and their outer walls form the downwardly projecting oblique end walls of the cover plate at the field sides of the track rails, as best shown in FIGS. 4 and 6, opposite ends 56 of cover plate 55 extending in the direction of the longitudinal extension of the machine frame project obliquely downwardly over the field sides of rails 59 towards the bases of the rails and, therefore, no tunnel-shaped elements are needed to cover the rails to keep the plowed ballast away from the rails. Cover plate 55 further includes forward end 58 opposite damming wall 53 and projecting obliquely downwardly towards the ties 57, forward cover plate end 58 having a transverse edge extending below the base of the rails. The illustrated ties are constituted by two concrete blocks supporting rails 59 and interconnected by steel carriers at the center of the track. Downwardly projecting cover plate end 58 will scoop up ballast in the region of the central interconnecting tie rods and move it to the cover plate to provide a lower ballast bed level at the center of the track than at the two tie blocks. Webs 61 at the lateral edges of cover plate end 58 prevent scooped-up ballast from flowing laterally off the cover plate end towards the rails and channel the ballast towards the cover plate.

As shown, each ballast guide plate 54 of plow arrangement 52 is hinged to damming wall 53 at a respective end thereof and is pivotal thereat about a vertical axis for adjustment of the desired angle.

Mobile machine 62 shown in FIG. 8 is a self-propelled ballast plow or regulator comprising machine frame 63 supported by undercarriages 64 on track 70 and propelled in the operating direction indicated by the arrow by drive 65. Vertically adjustable ballast plow arrangement 66 is mounted on the machine frame ahead of front undercarriage 64 and comprises an independently vertically adjustable ballast conveying device 67. A vertically adjustable ballast broom 68 with an associated transverse ballast conveyor is mounted on the machine frame rearwardly of rear undercarriage 64. The plow arrangement is operated in the same manner as hereinabove described.

While the ballast plow arrangement has been described in connection with concrete block ties, for which it is particularly suitable, it may be used also in connection with regular wood or concrete ties of a constant cross section.

What is claimed is:

1. A mobile machine for distributing and shaping the ballast bed of a railroad track consisting of two rails fastened to ties, each rail having a gage side, a field side, a running surface and a base supported on the ballast bed, which comprises (a) a machine frame supported by undercarriages on the track for mobility therealong in an operating direction, the machine frame having a longitudinal extension and opposite sides extending in the direction of the longitudinal extension, (b) a vertically adjustable ballast plow arrangement comprising (1) a substantially vertical ballast damming wall extending transversely to the longitudinal extension of the machine frame to the opposite machine frame sides, (2) a respective ballast guide plate associated with the damming wall at each machine frame side, each guide plate being adjustable to define a desired angle with the respective machine frame side, and (3) a cover plate preceding the damming wall in the operating direction and connected to the damming wall, the cover plate extending substantially parallel to a plane defined by the track and immediately above the running surfaces of the rails, and the cover plate including opposite ends associated with the rails and extending in the direction of the longitudinal machine frame extension, each cover plate end projecting obliquely downwardly towards the base of the rail associated therewith along the field side thereof, and (c) drive means vertically adjustably connecting the ballast plow arrangement to the machine frame.

2. The mobile machine of claim 1, wherein the damming wall defines openings immediately adjacent the gage sides of the rails, the cover plate forming lower edges of the openings.

3. The mobile machine of claim, 2 further comprising ballast distributing chutes surrounding the openings and affixed to a rear side of the damming wall, the chutes having lower outlets opposite the openings and extending substantially parallel to the track plane.

4. The mobile machine of claim 1, wherein the cover plate defines openings immediately adjacent the gage sides of the rails, and further comprising ballast distributing chutes surrounding the openings and affixed to an underside of the cover plate.

5. The mobile machine of claim 1, further comprising two tunnel-shaped elements associated with the two track rails and extending in the direction of the longitudinal extension of the machine frame, the tunnel-shaped elements bridging the rails and being connected to an underside of the cover plate.

6. The mobile machine of claim 1, wherein the cover plate further includes a forward end opposite the damming wall and projecting obliquely downwardly towards the ties, the forward cover plate end having a transverse edge extending below the base of the rails.

7. The mobile machine of claim 1, further comprising a power-driven ballast conveying device extending transversely to the longitudinal extension of the machine frame, the ballast conveying device being arranged above the cover plate and immediately preceding the damming wall in the operating direction.

8. The mobile machine of claim 7, wherein the ballast conveying device comprises a conveyor chain equipped with ballast conveying entrainment elements projecting from the conveyor chain, and two guide pulleys over which the conveyor chain is trained, the guide pulleys being arranged adjacent the opposite machine frame sides and having rotary axes extending parallel to the longitudinal machine frame extension.

9. The mobile machine of claim 8, wherein the conveyor chain has a lower course adjacent the cover plate and extending substantially parallel thereto, and comprising a reversible power drive for rotating the guide pulleys in selected opposite directions.

10. The mobile machine of claim 7, further comprising drive means independently connecting the ballast conveying device to the machine frame for vertically adjusting the device with respect to the machine frame.

11. The mobile machine of claim 1, each ballast guide plate is connected to the damming wall at a respective end thereof and is pivotal thereat about a vertical axis for adjustment of the desired angle.

12. The mobile machine of claim 11, further comprising a respective vertically and transversely adjustable shoulder ballast plow preceding each ballast guide plate in the operating direction.

13. The mobile machine of claim 1, further comprising two vertically adjustable flanged rollers connected to a rear side of the damming wall and arranged for engagement with the track rails, and drive means for vertically adjusting the flanged rollers.

14. The mobile machine of claim 1, further comprising an operating carrier frame longitudinally displaceably mounted on the machine frame and trailing the ballast plow arrangement in the operating direction, the operating carrier frame supporting a ballast tamping unit and a track leveling and lining unit preceding the ballast tamping unit in the operating direction whereby the machine constitutes a continuous action track leveling, lining and tamping machine.

* * * * *